United States Patent [19]

Molinaro

[11] Patent Number: 4,614,942

[45] Date of Patent: Sep. 30, 1986

[54] VISUAL SOUND DEVICE

[76] Inventor: Bernard J. Molinaro, 274 Elm St., Monroe, Conn. 06468

[21] Appl. No.: 533,151

[22] Filed: Sep. 19, 1983

[51] Int. Cl.[4] ..... G09G 3/00

[52] U.S. Cl. ..... 340/815.11; 340/754

[58] Field of Search ..... 340/815.11, 753, 754

[56] References Cited

U.S. PATENT DOCUMENTS

| | | | |
|---|---|---|---|
| 3,720,939 | 3/1973 | Polanek et al. | 340/815.11 |
| 3,806,919 | 4/1974 | Comey | 340/815.11 |
| 3,924,231 | 12/1975 | McClure | 340/815.11 |
| 4,295,136 | 10/1981 | Stoutenburg | 340/753 |

*Primary Examiner*—Marshall M. Curtis

[57] ABSTRACT

This invention describes a visual sound device for use in the visual interpretation of a received electrical sound signal, which has an electro visual means that responds visually in amplitude to the amplitude variations of the intelligence contained within a band of frequencies contained within the frequency spectrum of a received electrical sound signal. The device consists of at least one channel, which has a filter that passes the intelligence contained within the band pass of the filter and an amplifier which amplifies the intelligence, a rectifier for rectifying the amplified intelligence, and, a power amplifier which amplifies the rectified intelligence to a sufficient power level to drive an electro visual means which is connected at the output thereof. The electro visual means used in this form of the invention is a spotlight, which varies visually in amplitude to the amplitude variations of the intelligence passed by the filter. The device can be used for pleasure, such as when it is used to observe, in visual form, music, voice, or other sound signals present in electrical form at the output of a radio, a stereo, a public address system, a phonograph, a tape player, etc. Or, it can be used as a means of visually identifying the sources of sound contained in the audio range, as well as sources of sound contained in the ranges below and above the audio range. The device can contain any number of different channels. One of the channels contains a filter, which has a manually adjustable center frequency, which gives the device a search feature, which enables an operator to manually search the sound signal for a particular bit of information contained within the frequency range of the received electrical sound signal. The device, also, incorporates automatic gain control to compensate for the changes in the strength of the received electrical sound signal.

11 Claims, 2 Drawing Figures

VISUAL SOUND DEVICE

Figures 1, 2:
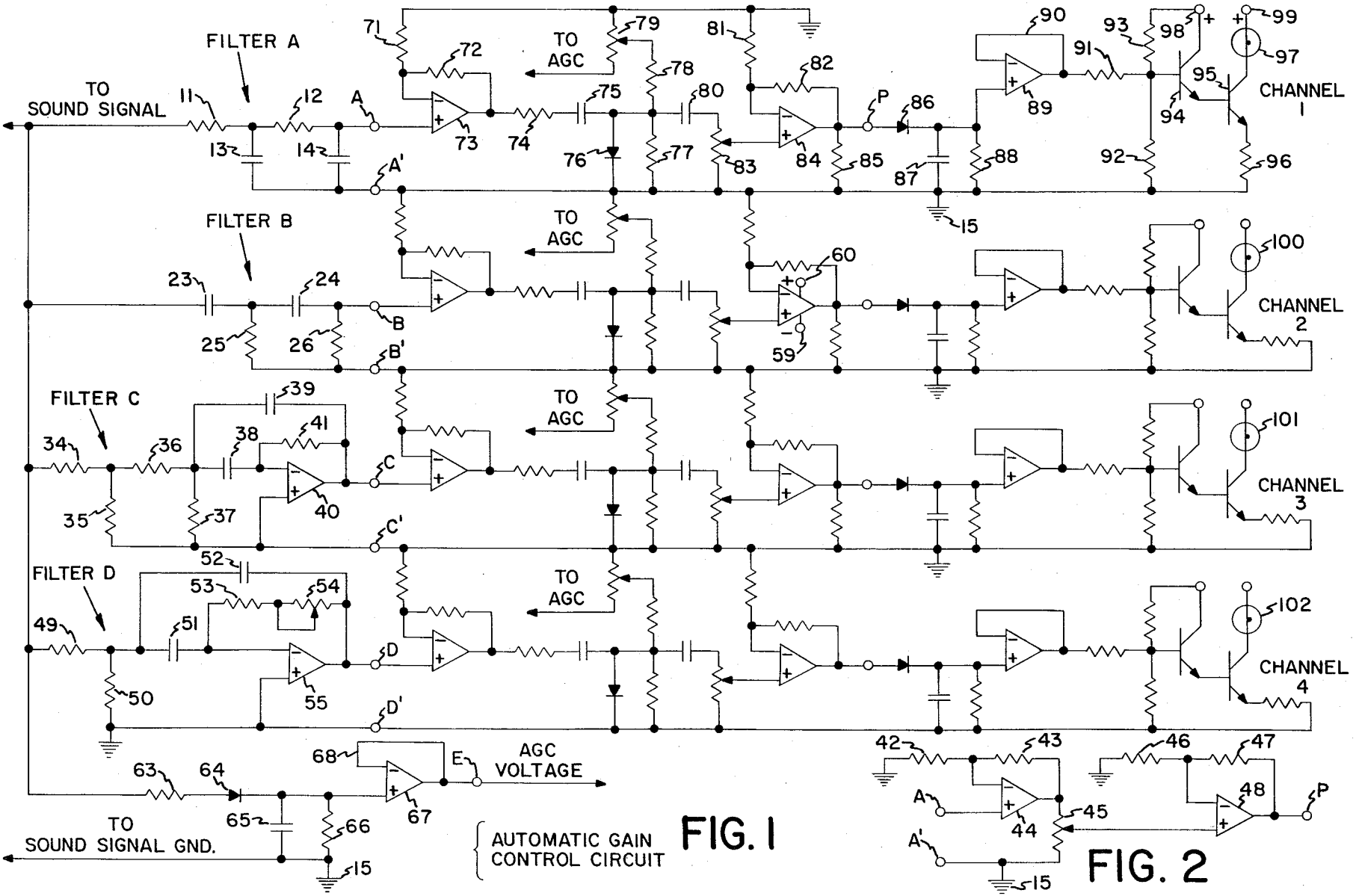

This invention relates to a sound device and more particularly to a visual sound device.

Present sound devices do not have the means for responding visually, in visual amplitude variations, to the amplitude variations of the intelligence contained within a band of frequencies contained within the frequency spectrum of a received electrical sound signal which will permit the visual interpretation of the said received electrical sound signal.

Present sound devices, as used today in combination with a visual display, use the visual display merely as an output level meter for the two output channels of a stereo amplifier for the purpose of balancing the sound level outputs of each of the two stereo amplifiers. Or, they use a visual display consisting of electric lamps connected to the output of different filter stages of an electric organ through a control rectifier device such as an SCR for the purpose of flashing in an on-off fashion, to the low, medium and high notes of an electric organ. Other devices use the switching action of a triac to switch lamps in a visual display in an on-off fashion. The lamps do not respond visually, in visual amplitude variations, to the amplitude variations of the voltages present at the outputs of the filters. Rather, they respond in an on-off fashion, to a voltage level, going on when the voltage at the output of the filter stages reach a preset voltage level, and the lamps go out when the voltage at the output of the filters fall below the said preset level. Therefore, these visual devices do not respond visually in visual amplitude variations, to the amplitude variations of the intelligence information present at the output of each of the filter stages. Rather, they respond visually at a constant amplitude in an on-off fashion to the amplitude variations of the intelligence information present at the output of each of the filter stages. Other visual devices merely respond to a variable time device or they respond to an operator controlled visual device, and therefore, they only simulate a response to an audio sound.

It is an object of the present invention to produce a visual sound device that has means for responding visually, in visual amplitude variations to the amplitude variations of the intelligence contained within a band of frequencies contained within the frequency spectrum of a received electrical sound signal, which permits the visual interpretation of the said received electrical sound signal.

Another object of the present invention is to produce a visual sound device with means for searching within a band of frequencies of a received electrical sound signal for particular bits of intelligent information and display this intelligence visually.

Another object of the invention is to produce a visual sound device which will visually reproduce the intelligence contained within the different bands of frequencies contained within a received electrical sound signal. Said visual sound device not being limited to bands of frequencies contained within the audio frequency range but also includes bands of frequencies contained above and below the audio frequency range.

Still another object of the present invention is to provide a visual sound device with means for automatically controlling the gain of the said device to compensate for changes in strength of the received electrical sound signal, such that, an operator will not have to continually adjust the gain of the device. And, the device so constructed will respond visually, in visual amplitude variations, not merely to the change in the strength of the received electrical sound signal, but rather, it will respond in visual amplitude variations more closely to the amplitude variations of the said passed intelligence that has been compensated for the changes in strength of the said received electrical sound signal.

These together with other objects and advantages which will become subsequently apparent resides in the details of construction and operation as more fully hereinafter described and claimed, reference being had to the accompanying drawing forming a part hereof, wherein like numerals refer to like parts throughout, and in which:

FIG. 1 is a schematic circuit diagram of a visual sound device made in accordance with one form of the present invention; and, FIG. 2 is a schematic diagram showing a modification which may be made in the circuit of FIG. 1.

Referring now more in detail to FIG. 1 of the drawing, there is provided in this form of the invention, a visual sound device containing four similarly constructed channels and an Automatic Gain Control circuit. Automatic Gain Control being abbreviated in the drawing as AGC. Each channel consists of a filter circuit, a power amplifying converting means, and an electro visual means. The filter circuit in each of the channels being designated as Filter A, Filter B, Filter C and Filter D. Each filter circuit is designed to pass a different band of frequencies contained within the total frequency spectrum of the received electrical sound signal. Therefore, the intelligence contained at the output of each filter is different. And, with the exception of the filter portion of each channel, the remaining portion of the circuit of each channel is the same and consists of a power amplifying converting means with an electro visual means connected at the output thereof. Filter A of channel 1 is a passive low pass filter. It consists of two resistor-capacitor sections. Resistor 11 and capacitor 13 being one section and resistor 12 and capacitor 14 being the second section. The input of Filter A is connected to the received electrical sound signal. The electrical sound signal can be derived from any suitable source of an electrical sound signal, such as, the output of one of the channels of a sterio amplifier, the output of a radio, the output of a public address system, etc. The device will then produce a visual response to the audio signal contained at the output of the stereo amplifier, the radio, the public address system or the output of any other audio sound device. However, if it is desired to have the device respond visually to sound signals which include sound frequencies above and below the audio range of frequencies then the input lead of the device would be connected to the output of a wide band amplifier which contains the band of sound signals desired. Filter A being a low pass filter allows only the intelligence contained within the low frequency band of the overall frequency spectrum of the sound signal to pass. The output of Filter A being indicated on the diagram at A, A'. The output point A of Filter A is connected to the noninverting input of the operational amplifier 73. Filter A output points A, A' are also the input points of the power amplifying converting means of channel 1 which, in this form of the invention, consists of a two stage amplifier which contains Automatic Gain Control (AGC) a detector and a power amplifier. And, connected at the output of the power amplifying converting means is an electro visual means used for visually displaying the power amplified intelligence contained at the output of the power amplifier. The two stage amplifier consists of operational amplifiers 73 and 84. The intelligence passed through Filter A is applied to the input of the operational amplifier 73, which is connected as a noninverting amplifier with its gain determined by the values of resistors 72 and 71. Operational amplifier 84 is also connected as a noninverting amplifier with its gain determined by the values of resistors 82 and 81. The gain of both amplifiers being designed so that both of the amplifiers will operate within their linear region. The two amplifiers, which are used to amplify the passed intelligence, are interconnected through an automatic gain control circuit consisting of resistor 74, capacitor 75, diode 76, resistor 77, resistor 78, potentiometer 79, capacitor 80 and potentiometer 83. The ACG, circuit used in this form of the invention works as follows: The resistance of diode 76 changes with increase or decrease in its current and since the diode 76 is part of an impedance ladder network, the intelligence signal drop across the diode will increase or decrease with an increase or decrease of its resistance. When the AGC voltage applied to potentiometer 79 increases, it causes an increase of D.C. current through diode 76. The increase in diode current causes a decrease in the diode resistance. And, because of the voltage divider principle applied in ladder networks, the intelligence signal, which is an A.C. signal, will decrease with the decrease in the diode resistance. This decrease in the intelligence voltage causes an effective drop in the gain of the amplifier stages interconnected thereby. The reverse action occurs when the AGC voltage decreases. This results in an increase of diode resistance with a resultant increase in the intelligence signal across the diode. The resistor 77 connected in parallel with diode 76 helps to linearize the voltage drop across the parallel combination. Capacitors 75 and 80 act as blocking capacitors to the D.C. AGC voltage applied to the diode 76. Potentiometer 79 is adjusted to the desired gain with maximum usable sound signal present at the input of the device. It is understood that other well known AGC circuits can be used, instead of the AGC circuit described above, to control the gain of the two stage amplifier.

Manual gain control for the channel is accomplished by means of the potentiometer 83, which has its arm connected to the non inverting input of operational amplifier 84.

The output of the operational amplifier 84 is connected to the detector circuit, which rectifies the amplified A.C. intelligence signal. It consists of diode 86, the capacitor 87, the load resistor 88 and the operational amplifier 89 connected as a voltage follower. The voltage follower being used to prevent loading of the rectifier circuit by the power amplifier. The power amplifier, amplifies the rectified intelligence linearly to a level sufficient to drive the electro visual means 97 connected at its output. The power amplifier used can be any suitable type of a power amplifier. However, in this form of the invention it consists of input resistor 91, transistor 94, the emitter of which is connected to the base of transistor 95, thereby, creating a darlington type amplifier. However, the B plus voltage applied to the collector circuit of each of the transistors is made different in this form of the invention, because transistor 95 is a power transistor operating at a higher voltage and current than transistor 94. Therefore, B plus 98 is lower than B plus 99. Resistors 92, 93, and 96 are the biasing and stabilizing resistors. The load 97 of the power amplifier is connected in the collector circuit of the power transistor 95. The load used here can be any electrical to visual device that will respond visually, in visual amplitude variations, to the amplitude variations contained in the collector circuit of the power transistor 95. And, since the electrical amplitude variations in the collector circuit is responsive to the amplitude variations of the intelligence passed by Filter A, load 97 is in effect an electro visual means which responds visually, in visual amplitude variations to the amplitude variations of the intelligence contained within a band of frequencies of the said received electrical sound signal.

The visual means 97 used in this form of the invention is a spotlight. And, altho, the visual means used in this form of the invention is a spotlight, it is understood that other electro visual means could be used, such as a low voltage lamp. And, the circuit can easily be modified to drive an oscillograph, a strip chart recorder, a laser or any other electro visual means, which will respond to or can easily be modified to respond to the amplitude variation of the intelligence signals contained within each of the channels as described. The device so constructed can be used as a means of identification by sound. Also, sounds below and above the audio range can be displayed visually, such that, sounds that would not normally be heard by humans could be interpreted visually for pleasure as well as a means of identifying the sound source. Therefore, this invention can be used as a means of visually identifying, any device that produces a sound whether the sound produced is in the audio range or in the audio range as well as sounds above and below the audio range. Identification being made by means of the different visual patterns made by the sound given off by the different devices. That is, every device that gives off a sound will produce visual patterns that are different for different devices and similar patterns for similarly constructed devices. Therefore, since similarly constructed devices gives off similar patterns and different devices gives off different patterns, simply by cataloging known patterns and comparing them with the pattern produced by an unknown device the unknown device can be identified.

Channel 2, 3, and 4 are constructed and function essentially as described for channel 1. However, the spotlights 97, 100, 101 and 102 used in each of the channels should preferably, be different colored. The different colored spotlights are more pleasing to the eye and provide additional information which is helpful to the user in the visual interpretation of the sound signals. Another difference in each of the channels is the type of filter used. In channel 1, a low pass filter is used. Indicated as Filter A, in the drawing. In channel 2, a high pass filter is used, indicated as Filter B. It consists of a two stage capacitor resistor passive filter. Capacitor 23 and resistor 25 being the first stage and capacitor 24 and resistor 26 being the second stage. The output of Filter B which is also the input to the power amplifying converting means of channel 2 is identified at B, B′ on the drawing. Channel 3, in this form of the invention, uses an active band pass filter, identified on the drawing as Filter C. It consists of resistors 34, 35, 36, 37, and 41, capacitors 38, 39 and the operational amplifier 40. The output of Filter C and the input to the power amplifying converting means of channel 3 is indicated at C, C′. Channel 4 uses an active narrow band pass filter. Its center frequency can be varied manually by the user. It is indicated in the drawing as Filter D. It consist of resistors 49, 50, 53 and potentiometer 54, capacitors 51, 52, and operational amplifier 55. Points D, D' being the output of Filter D. These points are also the input to the power amplifying converting means of channel 4. The center frequency of the filter is adjustable by means of the potentiometer 54. Varying the potentiometer 54 causes a change in the center frequency of the filter. In use, the operator would vary the potentiometer 54 to search for a particular bit of intelligence contained within the band of frequencies covered by the filter. This feature produces in the device, the advantage of being able to search for the beat of a drum, a particular note on a piano, a singers voice, etc, when the device is used as an audio visual sound device. When the device is used for identification purposes, sounds above, below and including the audio bands of frequencies can be searched for a particular bit of intelligence to help the user to more easily identify visually the source of the sound. Altho, the filter types described above were used in this form of the invention, it is understood that other types of filters could be used. Such as, active and passive L.C. type filter or one or more active and passive filters could be used. ie. Any other type of filters can be used. And, each filter could be interchanged in the channels or even the same type of filters could be used in more than one channel if it is so desired. Further, any number of channels could be added. Each with a particular filter. A device so constructed could be used advantageously when used for identification of the sound source.

The automatic gain control voltage circuit consists of the following: a diode rectifer 64, the efficiency improving capacitor 65 and the load resistor 66. This detector stage is followed by the operational amplifier 67 connected as a voltage follower. The voltage follower is used to prevent loading of the rectifier stage. Resistor 63 is a low value resistor and is merely used to prevent loading of the sound signal, which is connected to the input of the detector. The output of the voltage follower produces a D.C. Automatic Gain Control Voltage that increases or decreases with an increase or decrease in the overall strength of the electrical sound signal. Altho the power supply to each of the operational amplifiers have been omitted for clarity. It is here represented as 59 and 60 in the drawing. 59 being negative with reference to ground 15 and 60 being plus with respect to ground 15. Ground 15 being power ground as well as the signal ground.

Referring now to FIG. 2. There is shown a two stage amplifier, which may be used as a substitute for the two stage AGC controled amplifier described in FIG. 1. This two stage amplifier is much simpler in construction than the two stage AGC controlled amplifier of FIG. 1. However, it contains only a manual gain control. In the drawing it is shown as being substituted for the two stage AGC controled amplifier of channel 1. The input to the amplifier being indicated as A A' and its output being indicated as point P. The two stage amplifier is made up of an operational amplifier 44 with its associated gain determining resistors 42 and 43 together with the potentiometer 45 used as the manual gain control for the channel. And, the operational amplifier 48 with its gain determining resistors 46 and 47. Altho, FIG. 2 shows only one amplifier, any number of amplifiers of this type can be made and substituted for the amplifiers contained in any or all of the channels described under FIG. 1. Such a device could be useful if the strength of the received sound signal does not vary appreciably. Otherwise, an operator would have to continually adjust the gain of each of the channels every time the strength of the received electrical sound signal changed.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention as claimed.

Having thus completely and fully described the invention, what is now claimed as new is as follows:

1. A visual sound device for use in the visual interpretation of a received electrical sound signal containing at least one channel that responds visually in amplitude variations with the amplitude variations of the intelligence contained within a band of frequencies of the said received electrical sound signal, said channel consisting of a filter means having its input adapted to receive a source of the said received electrical sound signal and the said filter means in response thereto passes the intelligence, contained within a band of frequencies of the said received electrical sound signal, to the input of a power amplifying converting means which converts the said passed intelligence into a power amplified varying amplitude form of sufficient power and includes means for operating an electro visual means which is connected at the output thereof, throughout its operable brightness range in correspondence with the range of said amplitude variations, thereby converting the said received electrical sound signal into a visual amplitude varying output that follows the amplitude variations of the said passed intelligence.

2. A visual sound device for use in the visual interpretation of a received electrical sound signal as described in claim 1, in which the said visual sound device contains at least two channels of the type described therein, in which the bandpass of each of the said filter means is different and thereby different intelligence is passed to each of the said power amplifying converting means contained in each of the said channels, then in each of the said channels each of the said power amplifying converting means converts the said passed intelligence into a power amplified varying amplitude form of sufficient power to operate the electro visual means which is connected at the output thereof and in response thereto the said electro visual means converts the said power amplified varying amplitude form of the said passed intelligence into a visual amplitude varying output that follows the amplitude variations of the said passed intelligence.

3. A visual sound device for use in the visual interpretation of a received electrical sound signal as described in claim 2, in which the said power amplifying converting means contained in each of the said channels consists of: an amplifier connected to the output of the said filter means for amplifying the said passed intelligence, a detector connected to the output of the said amplifier for rectifying the said passed intelligence, the output of the said detector being connected to a power amplifier which power amplifies the said rectified intelligence to a sufficient power level to operate the electro visual means which is connected at the output thereof, and in response thereto, the said electro visual means converts the said rectified and power amplified varying amplitude form of the said passed intelligence into a visual amplitude varying output that follows the amplitude variations of the said passed intelligence.

4. The invention as described in claim 3, in which the said amplifiers connected at the output of each of the said filter means are of the automatic gain control (AGC) type in which the said gain of each of the said automatic gain control amplifiers is responsive to the change in strength of the said received electrical sound signal in an inverse proportional manner, whereby an increase in the strength of the said received electrical sound signal produces a decrease in the gain of the said automatic gain control amplifiers and a decrease in the strength of the said received electrical sound signal produces an increase in the gain of the said automatic gain control amplifiers, and thereby the said automatic gain control amplifiers compensates for the changes in strength of the said received electrical sound signal and maintains the relative strength of the said passed intelligence passed in each of the said channels, then in each of the said channels each of the said electro visual means being responsive thereto, converts the said rectified and power amplified varying amplitude form of the said passed intelligence into a visual amplitude varying output that follows the amplitude variations of the said passed intelligence which has been compensated for the change in strength of the said received electrical sound signal.

5. The invention, as described in claim 4, in which the said electro visual means connected at the output of each of the said power amplifiers is a spotlight, in which the said spotlights are preferably of different colors and in which each of the said spotlights are connected and adapted to operate as the load for the said power amplifier and being so connected and adapted each of the said spotlights converts the said power amplified varying amplitude form of the said passed intelligence into a visual amplitude varying output that follows the amplitude variations of the said passed intelligence.

6. The invention, as described in claim 2, in which the said filter means obtained in one of the said channels for passing the intelligence contained within a band of frequencies of the said received electrical sound signal is a low pass passive resistance capacitance filter which in response to a received electrical sound signal passes the intelligence contained within the low band of frequencies of the said received electrical sound signal to the input of a power amplifying converting means which is connected at the output thereof, and the means contained within another of the said channels for passing the intelligence contained within a band of frequencies of the said received electrical sound signal is a high pass, passive resistance capacitor filter which in response to a received electrical sound signal passes the intelligence contained within a high band of frequencies of the said received electrical sound signal to the input of a power amplifying converting means which is connected at the output thereof, the inputs of both of the said filter means being similarly adapted to be connected to a source of the said received electrical sound signal.

7. The invention as described in claim 2, in which at least one of the said means contained in one of the said channels for passing the intelligence contained within a band of frequencies of the said received electrical sound signal is an active band pass filter in which the input of the said active band pass filter is adapted to be connected to a source of the said received electrical sound signal and the output of the said active band pass filter is connected to the input of a power amplifying converting means which converts the said passed intelligence into a power amplified varying amplitude form of sufficient power to operate an electro visual means connected at the output thereof, and in response thereto, the said electro visual means converts the said power amplified varying amplitude form of the said passed intelligence into a visual amplitude varying output that follows the amplitude variations of the said passed intelligence passed by the said active band pass filter.

8. The invention as described in claim 2, in which at least one of the said means contained in one of the said channels used for passing the intelligence contained within a band of frequencies of the said received electrical sound signal is an active narrow bandpass filter of the variable center frequency type, the input of the said active narrow bandpass filter is adapted to be connected to a source of the said received electrical sound signal and the output of the said active narrow bandpass filter is connected to the input of one of the said power amplifying converting means which has an electro visual means connected at the output thereof, the said active narrow bandpass filter of the variable center frequency type in response to the said received electrical sound signal passes the intelligence, contained within a variable narrow band of frequencies contained within the frequency range of the said received electrical sound signal, to the said power amplifying converting means which converts the said passed intelligence into a power amplified varying amplitude form of sufficient power to operate the electro visual means connected at the output thereof, and in response thereto the said electro visual means converts the said power amplified varying amplitude form of the said passed intelligence into a visual amplitude varying output that follows the amplitude variations of the said passed intelligence passed by the said narrow bandpass filter of the variable center frequency type.

9. The invention, as described in claim 2, in which at least one of the said filter means contained in one of the said channels used for passing the intelligence contained within a band of frequencies of the said received electrical sound signal is an active narrow bandpass filter of the variable center frequency type in which the said center frequency is manually variable to permit an operator to manually vary the center frequency of the said active narrow bandpass filter, and thereby the said operator can manually search for particular bits of sound information contained within the frequency range of the said received electrical sound signal, the input of the said active narrow bandpass filter is adapted to be connected to a source of the said received electrical sound signal and the output of the said active narrow bandpass filter is connected to the input of one of the said power amplifying converting means which has an electro visual means connected at the output thereof, the said active narrow bandpass filter in response to the said received electrical sound signal passes the intelligence contained within a manually variable narrow band of frequencies contained within the frequency range of the said received electrical sound signal, to the said power amplifying converting means which converts the said passed intelligence into a power amplified varying amplitude form of sufficient power to operate the electro visual means connected at the output thereof, and in response thereto, the said electro visual means converts the said power amplified varying amplitude form of the said passed intelligence into a visual amplitude varying output that follows the amplitude variations of the said passed intelligence passed by the said narrow bandpass filter of the manually variable center frequency type.

10. The invention as described in claim 8, in which the said center frequency of the said active narrow bandpass filter is varied by means of a potentiometer that is connected and arranged so as to produce a change in the center frequency of the said active narrow bandpass filter in response to the manual variations in the resistance of the said potentiometer.

11. A visual sound device for use in the visual interpretation of a received electrical sound signal consisting of a plurality of channels in which each of the said channels has means responsive to the said received electrical sound signal for passing the intelligence contained within a band of frequencies of the said received electrical sound signal, means responsive to the said passed intelligence for converting the said passed intelligence into a power amplified varying amplitude form of sufficient power and includes means for operating an electro visual means, which is connected at the output thereof, throughout its operable brightness range in correspondence with the range of said amplitude variations, thereby converting the said received electrical sound signal into a visual amplitude varying output that follows directly the amplitude variations of the said passed intelligence.

* * * * *